US005675906A

United States Patent [19]

Li et al.

[11] Patent Number: 5,675,906

[45] Date of Patent: Oct. 14, 1997

[54] ENCLOSED TYPE AIR CIRCULATION DRYING MECHANISM FOR LOW TEMPERATURE, NORMAL TEMPERATURE AND LOW HEAT CONDITIONS

[76] Inventors: Tsung Li Li; Tsung Hwa Li; Yuan Jiun You; Hsi Mei Lee, all of P.O. Box 63-99, Taichung, Taiwan

[21] Appl. No.: 717,345

[22] Filed: Sep. 20, 1996

[51] Int. Cl.[6] ..... F26B 21/06

[52] U.S. Cl. ..... 34/77; 34/215; 34/233

[58] Field of Search ..... 34/77, 78, 80, 34/86, 196, 197, 202, 205, 209, 210, 212, 215, 219, 225, 230, 233; 62/440

[56] References Cited

U.S. PATENT DOCUMENTS

| | | | |
|---|---|---|---|
| 3,067,522 | 12/1962 | Teigen | 34/77 |
| 4,012,847 | 3/1977 | Rand | 34/78 X |
| 4,257,169 | 3/1981 | Pierce | 34/471 |
| 4,532,720 | 8/1985 | Uchida | 34/471 |
| 4,699,119 | 10/1987 | Benko et al. | 34/233 X |
| 5,329,782 | 7/1994 | Hyde | 62/90 |
| 5,343,632 | 9/1994 | Dinh | 34/507 |

*Primary Examiner*—John M. Sollecito
*Assistant Examiner*—Steve Gravini

[57] ABSTRACT

An enclosed type air circulation drying mechanism includes a housing for receiving the food. The housing has two side chambers each for receiving a blower and two heating members and an evaporator for drying the air. Two or more fans are disposed in the side chambers and arranged in an antisymmetric condition for generating an eddy current and for removing the humidity from the food. The refrigerant is received in a low pressure container and pumped to a condenser by a compressor. An evaporator may remove the humidity from the air.

1 Claim, 4 Drawing Sheets

ENCLOSED TYPE AIR CIRCULATION DRYING MECHANISM FOR LOW TEMPERATURE, NORMAL TEMPERATURE AND LOW HEAT CONDITIONS

BACKGROUND OF THE INVENTION

1. Field of the Invention

The present invention relates to a drying mechanism, and more particularly to an enclosed type air circulation drying mechanism for drying food.

2. Description of the Prior Art

Typically, food is dried by high temperature method or by quickly refrigerating or freezing process. However, the food treated by these two methods may be deformed and may include a greatly decreased volume which is adverse for marketing purposes. In addition, the nourishment, the nutriment, the cellulose and the vitamin of the food will spoil.

The present invention has arisen to mitigate and/or obviate the afore-described disadvantages of the conventional mechanisms for drying food.

SUMMARY OF THE INVENTION

The primary objective of the present invention is to provide an enclosed type air circulation drying mechanism which may provide low temperature condition, normal temperature and slightly heating condition for gently drying food and for preserving the original shape and the nutriment of the food.

In accordance with one aspect of the invention, there is provided an enclosed type air circulation drying mechanism for drying food, the drying mechanism comprises a housing for receiving the food, the housing including an interior and a water outlet and including two side chambers, two blowers disposed in the side chambers for forcing an air from the interior of the housing into the side chambers, two first heating members disposed in the side chambers for heating the air, two evaporators disposed in the side chambers for drying the air and for removing humidity from the air and for forming dried air, two second heating members disposed in the side chambers for heating the dried air, at least two fans disposed in the side chambers respectively for circulating the dried air into the interior of the housing, the fans being arranged in an antisymmetric condition for generating an eddy current and for removing the humidity from the food, a low pressure container for receiving refrigerant therein, a compressor coupled to the low pressure container for pumping the refrigerant, a condenser coupled to the compressor for receiving the refrigerant from the compressor and for cooling the refrigerant, a high pressure container coupled to the condenser for receiving the cooled refrigerant from the condenser, a solenoid and a check valve and a window and an expansion valve coupled in series to the high pressure container and coupled to the evaporators for supplying the cooled refrigerant air into the evaporators, the evaporators being coupled to the low pressure container for allowing the refrigerant to flow into the low pressure container.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
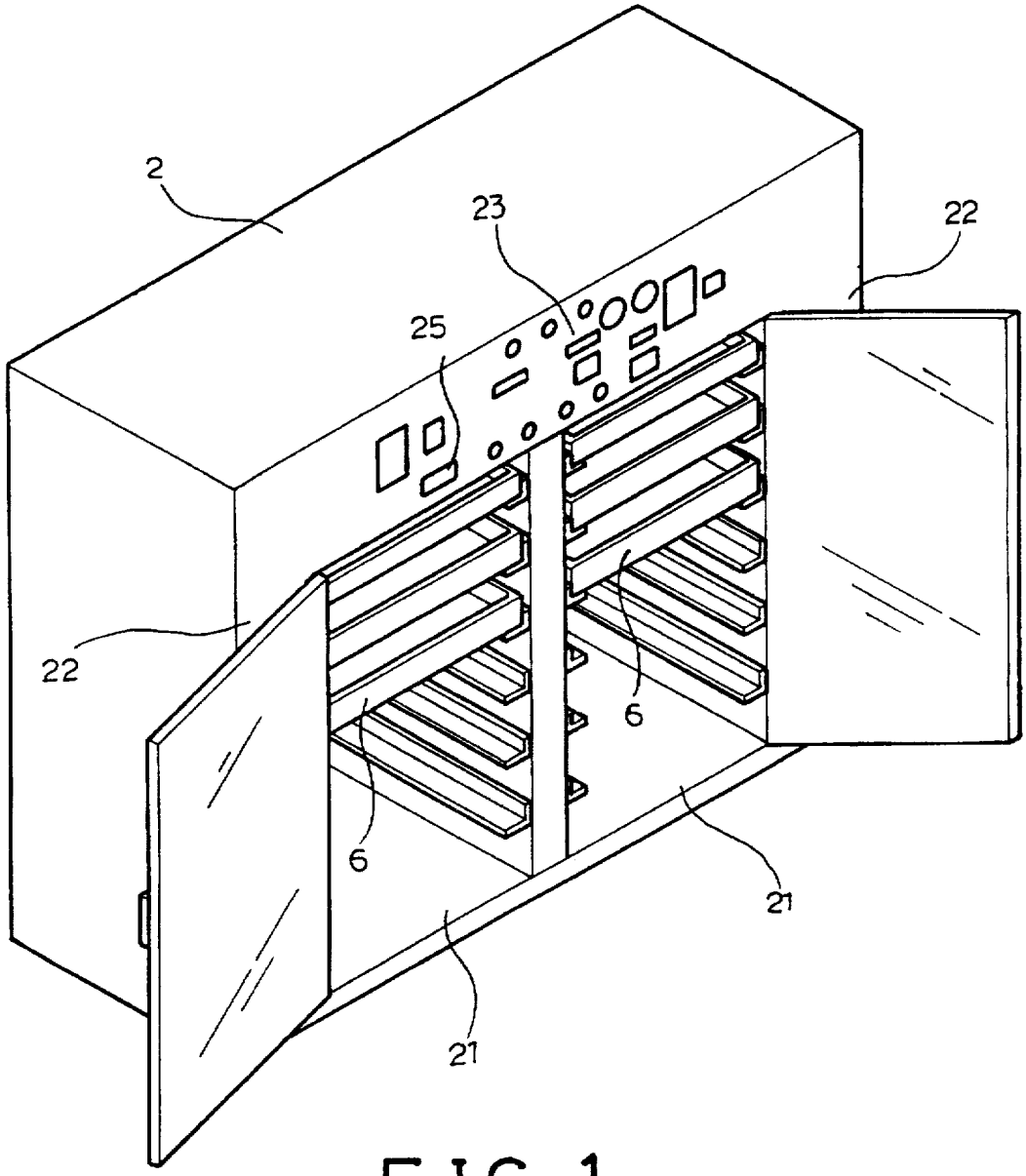
FIG. 1 is a perspective view of an enclosed type air circulation drying mechanism in accordance with the present invention.
Figure 2:
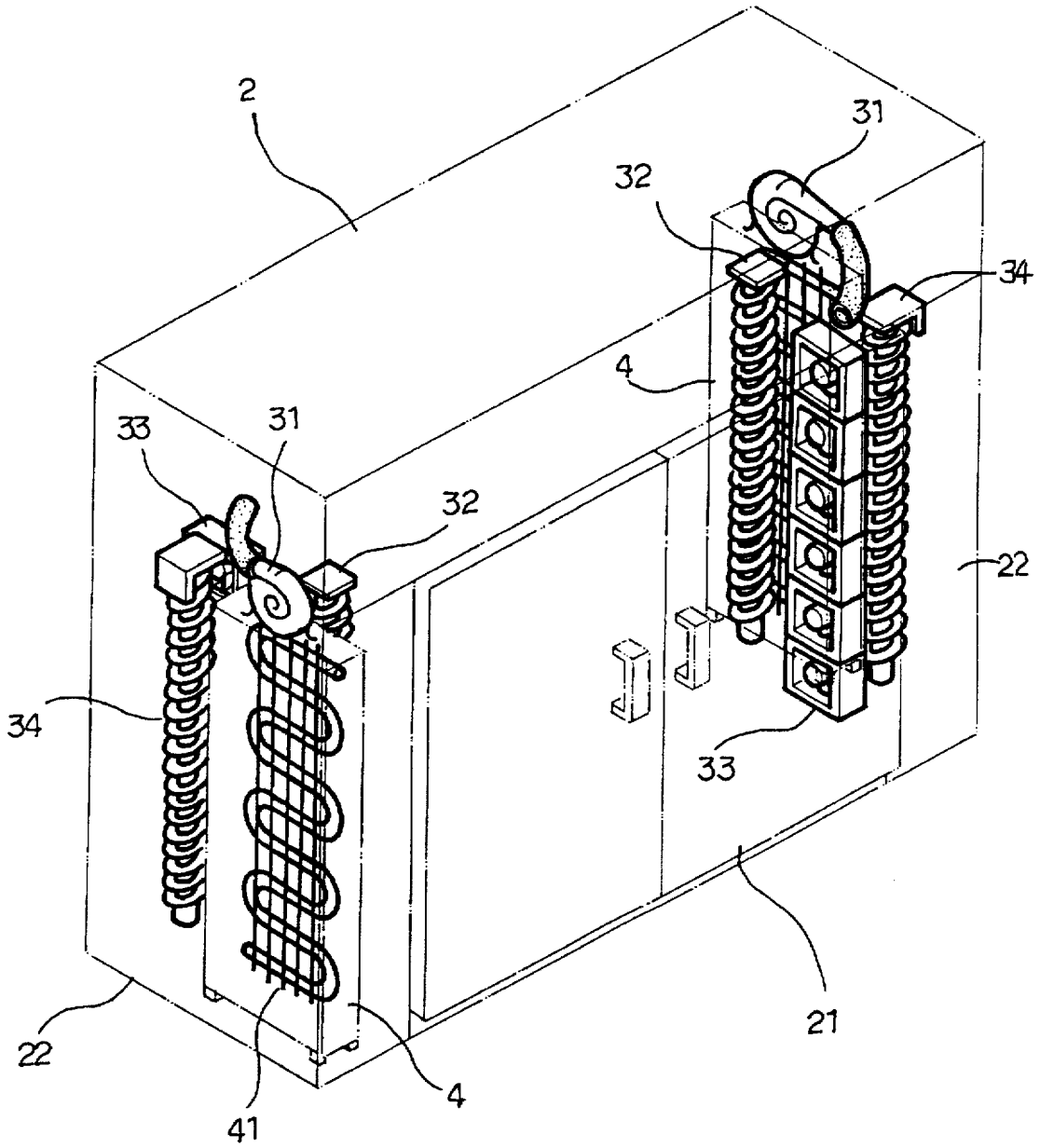
FIG. 2 is a partial perspective view for showing a portion of the interior of the enclosed type air circulation drying mechanism.
Figure 3:
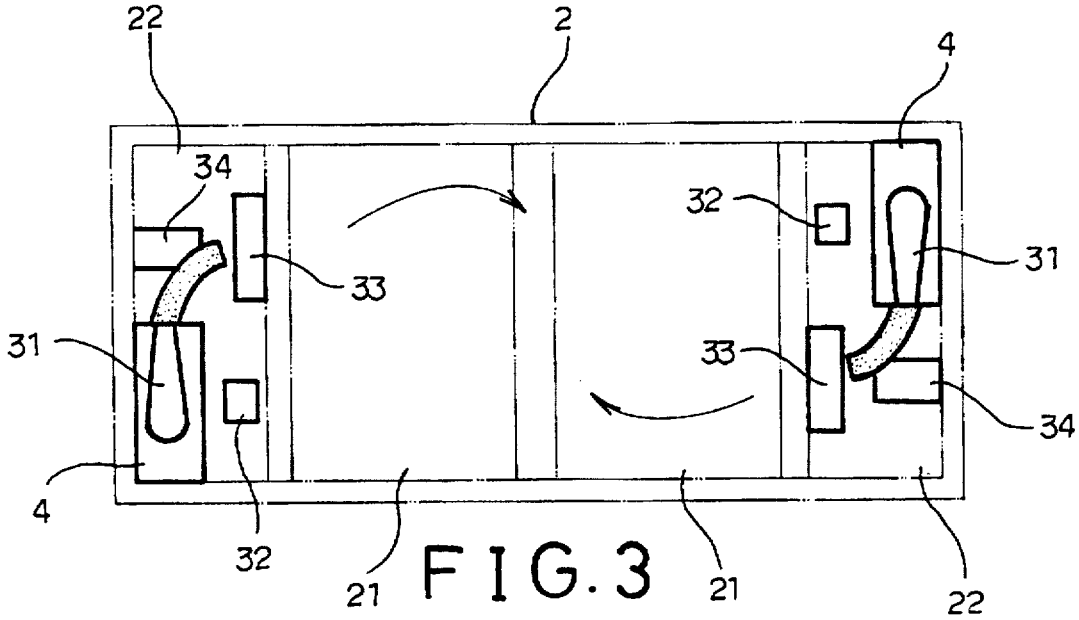
FIG. 3 is a partial top plane schematic view for showing the air circulation condition of the enclosed type air circulation drying mechanism.

An enclosed type air circulation drying mechanism in accordance with the present invention is provided for drying food under lower pressure and normal temperature and slightly heating conditions. Referring to the drawings, and initially to FIGS. 1 to 4, an enclosed type air circulation drying mechanism in accordance with the present invention comprises a housing 2 having a number of shelves 6 provided in the interior 21 thereof for supporting food in the housing 2. The housing 2 includes a number of control buttons 23, 25 provided thereon for controlling the operation of the drying mechanism. The housing 2 includes two side chambers 22 each of which is provided for receiving two heating members 32, 34 and a number of fans 33 and a blower 31 and a device 4 for cooling and for dehumidifying purposes. The devices 4 each includes an evaporator 41 vertically disposed in the respective chambers 22. As best shown in FIGS. 2 and 3, the fans 33 and the devices 4 received in the two chambers 22 are arranged in an antisymmetric condition such that the air circulated by the fans 33 may generate an eddy current which is excellent for contacting and for engaging with the food and for removing the humidity from the food. The housing 2 includes an outlet 24 (FIG. 4) arranged below the evaporator 41 for discharging the condensed water.

Figure 4:
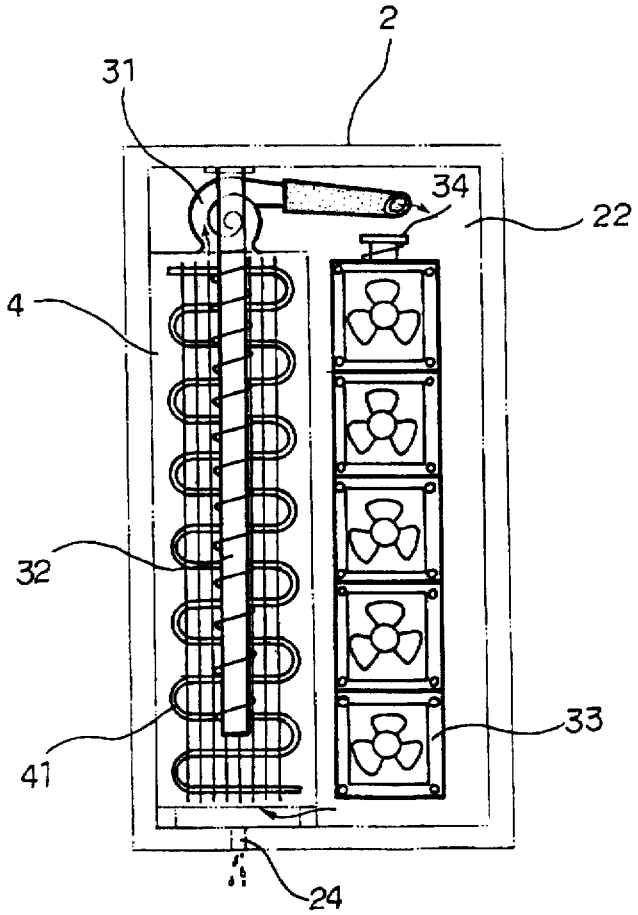
FIG. 4 is a partial side plane schematic view for showing the device provided in the inner and side portion of the air circulation drying mechanism.
Figure 5:
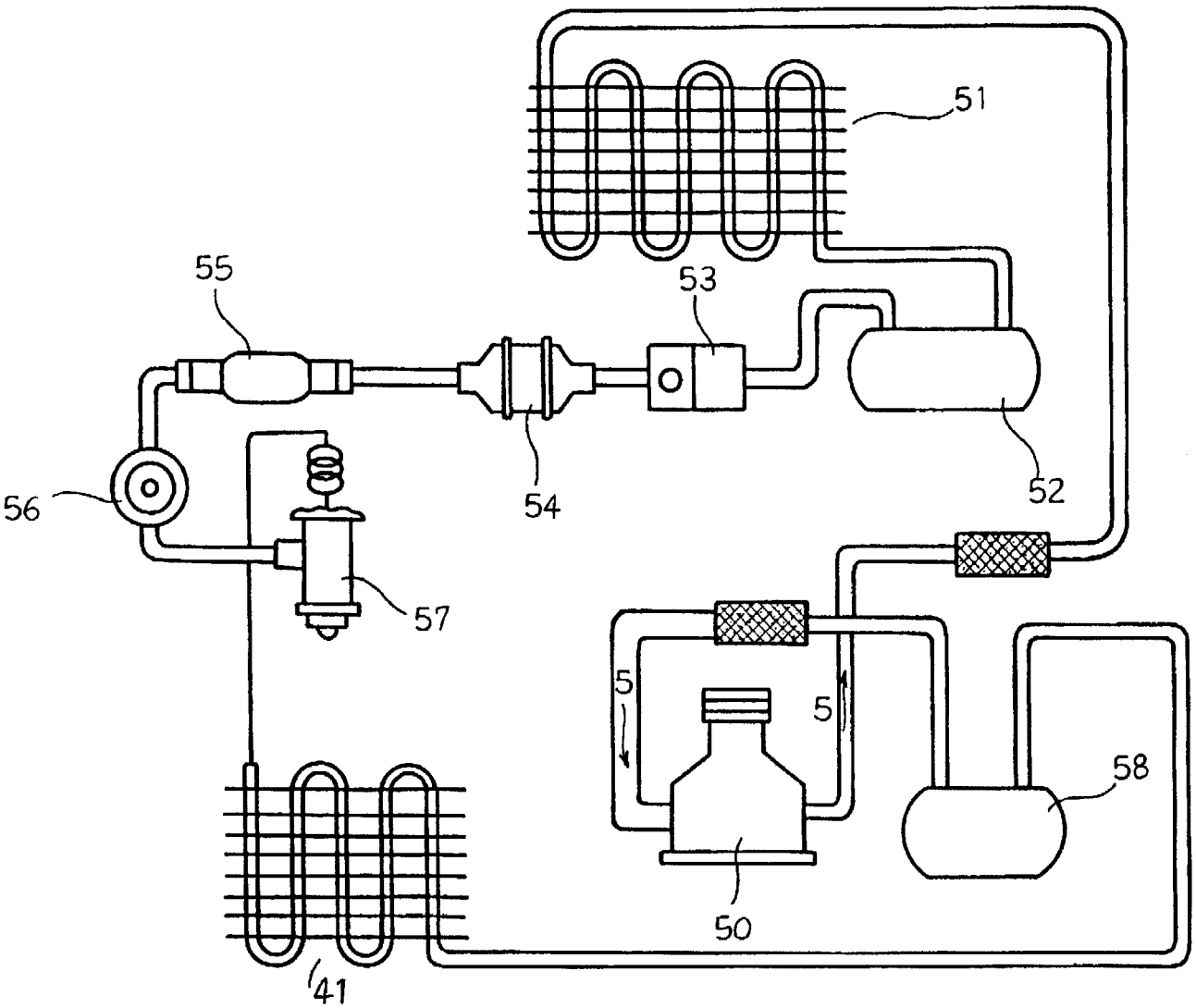
FIG. 5 is a schematic view showing the flowing system of the air circulation drying mechanism.

Referring next to FIG. 5, illustrated is the flowing system of the enclosed type air circulation drying mechanism. The flowing system comprises a compressor 50 for pumping the refrigerant into the condenser 51 for decreasing the temperature and for cooling the refrigerant. The cooled refrigerant is then supplied into a high pressure liquid container 52 and supplied to a filter 54 via a magnetic switch or solenoid 53, and is then supplied into an expansion valve 57 via a check valve 55 and a window 56, and is then supplied into the evaporator 41 for condensing the humidity into water which is allowed to flow out of the housing 2 via the outlet 24 (FIG. 4). The refrigerant is then moved to the low pressure liquid container 58 so as to be pumped into the condenser 51 by the compressor 50.

The heating member 32 may heat the air which is then forced to flow into the chambers 22 by the blower 31 so as to allow the humidity of the air to be condensed into water by the evaporator 41. The heating member 34 may then heat the dried air into a temperature ranging from 15° C. to 30° C. The heated air may then flow into the interior 21 of the housing 2 by the fans 33 and may generate an eddy current which is excellent for contacting and for engaging with the food and for removing the humidity from the food. The air carrying the humidity from the food is then forced to flow into the chambers 22 again by the blowers 31 so as to remove the humidity again. The housing 2 includes a switch 25 (FIG. 1) for actuating an ozone device which may supply ozone into the interior 21 for removing stink and for killing germs.

When the heating member 34 is switched off, the temperature of the dried air may be maintained in the range from 0° C. to 15° C. When the evaporator 41 is switched off, the temperature of the dried air may range from 30° C. to 70° C.

It is to be noted that the interior of the housing 2 may be maintained in different temperature ranges from 0° C. to 15° C., or from 15° C. to 30° C. or from 30° C. to 70° C. In addition, the air in the housing 2 will not be heated to a large temperature and will not be refrigerated to a very low temperature, the temperature of the housing is maintained in room temperature such that the nutriment of the food will not be spoiled.

Accordingly, the enclosed type air circulation drying mechanism may preserve the original shape of the food and may prevent the nutriment of the food from being spoiled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An enclosed type air circulation drying mechanism for drying food, said drying mechanism comprising:

a housing for receiving said food, said housing including an interior and a water outlet and including two side chambers, two blowers disposed in said side chambers for forcing an air from said interior of said housing into said side chambers, two first heating members disposed in said side chambers for heating the air, two evaporators disposed in said side chambers for drying the air and for removing humidity from the air and for forming dried air, two second heating members disposed in said side chambers for heating the dried air, at least two fans disposed in said side chambers respectively for circulating the dried air into the interior of said housing, said fans being arranged in an antisymmetric condition for generating an eddy current and for removing the humidity from the food, a low pressure container for receiving refrigerant therein, a compressor coupled to said low pressure container for pumping the refrigerant, a condenser coupled to said compressor for receiving the refrigerant from said compressor and for cooling the refrigerant, a high pressure container coupled to said condenser for receiving the cooled refrigerant from said condenser, a solenoid and a check valve and a window and an expansion valve coupled in series to said high pressure container and coupled to said evaporators for supplying the cooled refrigerant air into said evaporators, said evaporators being coupled to said low pressure container for allowing the refrigerant to flow into said low pressure container.

* * * * *